US005244784A

United States Patent [19]

Moriya et al.

[11] Patent Number: 5,244,784

[45] Date of Patent: Sep. 14, 1993

[54] SILVER HALIDE PHOTOGRAPHIC MATERIALS

[75] Inventors: Tomonobu Moriya; Kazuhiro Yoshida, both of Hino, Japan

[73] Assignee: Konica Corporation, Tokyo, Japan

[21] Appl. No.: 662,188

[22] Filed: Feb. 28, 1991

[30] Foreign Application Priority Data

Mar. 1, 1990 [JP] Japan ..... 2-50770

[51] Int. Cl.[5] ..... G03C 1/005

[52] U.S. Cl. ..... 430/642; 430/403; 430/510; 430/567; 430/963

[58] Field of Search ..... 430/642, 510, 963, 567, 430/403

[56] References Cited

U.S. PATENT DOCUMENTS 4,144,064 3/1979 Vermeulen et al. ..... 430/510
4,897,340 1/1990 Ohtani et al. ..... 430/403

FOREIGN PATENT DOCUMENTS 0219010 10/1986 European Pat. Off. .
0258903 9/1987 European Pat. Off. .
0307867 9/1988 European Pat. Off. .
2-39038 7/1988 Japan .

*Primary Examiner*—Charles L. Bowers, Jr.
*Assistant Examiner*—Thorl Chea
*Attorney, Agent, or Firm*—Finnegan, Henderson, Farabow, Garrett & Dunner

[57] ABSTRACT

An improved silver halide photographic materials comprising a support and a photographic layer unit thereon. The improvement is such that said photographic layer unit comprises a light sensitive layer having silver halide grains, of which a chloride content is not less than 30 mol %, and said photographic layer unit comprises not more than 2.8 g/m$^2$ of gelatin, and a portion not less than 50 wt % of said gelatin has a jelly strength of not less than 240.

9 Claims, No Drawings

SILVER HALIDE PHOTOGRAPHIC MATERIALS

BACKGROUND OF THE INVENTION

This invention relates to a silver halide photographic material, more particularly to a method of forming an image on light-sensitive materials for use in printing and platemaking that are adapted for rapid access photography and efficient coating operations.

With the growing need for rapid access and improved image quality in the printing and platemaking industries, it is desired to provide silver halide photographic materials for use in printing and platemaking that can be rapidly processed (no longer than 50 seconds in dry-to-dry time) to produce a high contrast image having a gamma value of 6.0 and above in the density range of 0.3–3.0.

One way to achieve rapid access photography within a dry-to-dry time of 50 seconds is to elevate the temperature in development and fixing steps but this approach has several defects including the low keeping quality of processing solutions and the increased evaporation of gases in the laboratory. Under these circumstances, it is preferred to perform rapid processing at the lowest possible temperature (no higher than 38° C.). On the other hand, rapid access photography has the inherent tendency to cause a drop in maximum density, as well as insufficient fixing and drying.

Using less binder, in particular gelatin, is a very effective means of permitting silver halide photographic materials to be processed at low temperatures. In practice, however, the use of a smaller amount of gelatin results in deteriorated coating efficiency as evidenced by uneven coating and variations in the thickness of applied layers at both lateral edges and the resulting "rainbow gloss" can lead to a lower production rate.

SUMMARY OF THE INVENTION

The present invention has been achieved under these circumstances and has as its object providing a silver halide photographic material which can be rapidly processed within a dry-to-dry time of 50 seconds to produce a satisfactory high contrast image with efficient coating even in the presence of a reduced amount of gelatin without causing any problems including insufficient fixing and drying, uneven coating and "rainbow gloss".

This object of the present invention can be attained by a silver halide photographic material comprising a support and a photographic layer unit thereon, wherein said photographic layer unit comprises a light sensitive layer having silver halide grains, of which a chloride content is not less than 30 mol %, and said photographic layer unit comprises not more than 2.8 g/m$^2$ of gelatin, and a portion not less than 50 wt % of said gelatin has a jelly strength of not less than 240.

DETAILED DESCRIPTION OF THE INVENTION

The present invention is described below in detail. First, the gelatin to be used in the present invention on the side of a photographic material support that carries light-sensitive layers is discussed.

Gelatin is conventionally manufactured by either an acid process or an alkali (lime) process. The acid process mostly uses pork skins as a starting material and the alkali process uses cow bones or skins. Photographic gelatins are mostly made from insoluble collagen (ossein) from cow bones which is immersed in a suspension of slaked lime to perform an alkali treatment. During this alkali treatment, changes occur in the physical structure and chemical composition of collagen and such changes will greatly affect the rate of dissolution of gelatin into warm water, as well as its properties. The physical properties of gelatin depend on the ossein used as the starting material and the conditions of liming, with a particularly significant factor being the conditions of extraction with warm water such as temperature, pH and time. Hence, the "first extract" or gelatin extracted in the initial run has the best physical properties.

Needless to say, the physical properties of a particular silver halide photographic material after coating are largely dependent on the gelatin used as a binder in coating solutions.

In accordance with the present invention, the jelly strength which is a measure of the physical properties of gelatin, as well as the relative proportions of silver and binder gelatin are properly controlled to improve the physical properties of silver halide photographic material after coating so that coating operations can be performed evently without causing any "rainbow gloss".

The jelly strength of gelatin used in the present invention is measured by the PAGI method.

The gelatin content of the photographic layer unit is preferably in the range of 1.0–2.8 g/m$^2$. The gelatin in the photographic layer preferably has a jelly strength of 240–350.

An anti-halo layer may be coated on the side of the photographic material support that is opposite to the side carrying light-sensitive layers. The gelatin in the anti-halo layer may have any jelly strength but it preferably has a jelly strength of at least 240. The gelatin content of the anti-halo layer is preferably in the range of 2.8–4.5 g/m$^2$.

The silver halide emulsion to be used in the photographic material of the present invention contains silver chloride, silver chlorobromide, silver chloroiodobromide or any other silver halides, but it should contain at least 30 mol %, preferably at least 50 mol %, more preferably at least 60 mol %, of AgCl. The silver halide grains preferably have an average size of 0.1–1 μm and more preferably they have a narrow grain size distribution such that the coefficient of variation as expressed by (standard deviation of grain size/average grain size)×100 is no more than 15%.

The content of silver in the silver halide photographic material of the present invention is not limited to any particular value and the method of the present invention can be applied effectively not only to photographic materials of low silver content but also to those of high silver content which is not less than 3.5 g/m$^2$.

The photographic emulsion to be used in the present invention can be sensitized by sulfur or gold-plus-sulfur sensitization; if necessary, these sensitization methods may be combined with reduction sensitization using reducing materials or noble metal sensitization using noble metal compounds.

In the process of silver halide grain formation and/or growth, metal ions may be added using cadmium salts, zinc salts, lead salts, thallium salts, iridium salts or complex salts thereof, rhodium salts or complex salts thereof or iron salts or complex salts thereof, whereby those ions are incorporated within and/or on the surface of the grains.

Another important feature of the silver halide photographic material of the present invention is that it has high contrast photographic performance characterized by a gamma value of 6.0 as defined for the density range of 0.3–3.0. A particularly preferred means of achieving this high contrast photographic performance is to incorporate a tetrazolium compound or a hydrazine compound or a polyalkylene oxide compound either in at least one of the hydrophilic colloidal layers containing a light-sensitive silver halide emulsion or in an adjacent layer or in both layers and to process the photographic material with a developing solution that contains HQ either alone or in combination with PQ or MQ as a developing agent and which has a pH of 10–13.

The photographic material of the present invention may further contain various additives in accordance with a specific object. Detailed information on such additives is given in Research Disclosure Vol. 176, Item 17643 (December 1978) and ibid, Vol. 187, Item 18716 (November 1979) and the relevant portions of these references are summarized in the following table.

| Additive | RD 17643 | RD 18716 |
|---|---|---|
| 1. Chemical sensitizer | p. 23 | p. 648, right col. |
| 2. Sensitivity enhancer | | do. |
| 3. Spectral sensitizer, supersensitizer | pp. 23–24 | p. 648, right col. to p. 649, right col. |
| 4. Optical brightening agent | p. 24 | |
| 5. Antifoggant and stabilizer | pp. 24–25 | p. 649, right col. |
| 6. Light absorber, filter dye, UV absorber | pp. 25–26 | p. 649, right col. to p. 650, left col. |
| 7. Anti-stain agent | p. 25, right col. | p. 650, left and right col. |
| 8. Dye image stabilizer | p. 25 | |
| 9. Hardener | p. 26 | p. 651, left col. |
| 10. Binder | p. 26 | do. |
| 11. Plasticizer, lubricant | p. 27 | p. 650, right col. |
| 12. Coating aid, surfactant | pp. 26–27 | do. |
| 13. Antistatic agent | p. 27 | do. |

In practice, emulsion layers and other photographic layers may be coated onto one or both sides of commonly used flexible supports to make the silver halide photographic material of the present invention. Useful flexible supports include films made of semi-synthetic or synthetic polymers such as cellulose nitrate, cellulose acetate, cellulose acetate butyrate, polystyrene, polyvinyl chloride, polyethylene terephthalate and polycarbonate, as well as paper coated or laminated with a baryta layer or α-olefinic polymers (e.g. polyethylene, polypropylene and an ethylene/butene copolymer). These supports may be tinted with dyes or pigments. If desired, the supports may be rendered black for light shielding purposes. The surface of these supports is usually subbed in order to provide better adhesion to emulsion and other photographic layers. Preferred methods of subbing are described in Unexamined Published Japanese Patent Application Nos. 104913/1977, 18949/1984, 19940/1984 and 11941/1984.

Prior to or after the subbing treatment, the surface of the supports may be subjected to suitable surface treatments such as corona discharge treatment, irradiation with ultraviolet rays and flame treatment.

In making the silver halide photographic material of the present invention, photographic emulsion layers and other hydrophilic colloidal layers may be applied onto the support or other layers by various coating methods including dip coating, roller coating, curtain coating and extrusion coating.

Developing agents that can be used with advantage to develop the silver halide photographic material of the present invention are described in The Theory of the Photographic Process, T. H. James, Fourth Edition, pp. 291–334, Macmillan Publishing Co., Inc. and Journal of the American Chemical Society, Vol. 73, No. 3, p. 100 (1951). Those developing agents may be used alone but preferably they are used as admixtures. The developing solution to be used to develop the photographic material of the present invention may contain sulfites (e.g. sodium sulfite and potassium sulfite) as preservatives without compromising the objects of the present invention and this may be mentioned as another advantage of the present invention. Other compounds that can be used as preservatives are hydroxylamine and hydrazide compounds. If desired, both pH adjustment and buffering action can be provided by using caustic alkalis, alkali carbonates, amines and other compounds that are commonly used in black-and-white developing solutions. It is also optional to add inorganic development restrainers (e.g. potassium bromide), organic development restrainers (e.g. benzotriazole), metal ion sequestrants (e.g. ethylenediaminetetraacetic acid), development accelerators (e.g. methanol, ethanol, benzyl alcohol and polyalkylene oxides), surfactants (e.g. sodium alkylarylsulfonates, natural saponin, saccharides and alkyl esters of these compounds), hardeners (e.g. glutaraldehyde, formaldehyde and glyoxal), and ionic strength modifiers (e.g. sodium sulfate).

The developing solution to be used to develop the photographic material of the present invention may contain alkanolamines and glycols as organic solvents. Preferred alkanolamines include monoethanolamine, diethanolamine and triethanolamine, with triethanolamine being preferred. These alkanolamines are preferably used in amounts ranging from 5 to 500 g, more preferably from 20 to 200 g, per liter of the developing solution. Preferred glycols include ethylene glycol, diethylene glycol, propylene glycol, triethylene glycol, 1,4-butanediol and 1,5-pentanediol, with diethylene glycol being preferred. These glycols are preferably used in amounts ranging from 5 to 500 g, more preferably from 20 to 200 g, per liter of the developing solution. The organic solvents listed above may be used either alone or as admixtures.

The silver halide photographic material of the present invention will have very good storage stability if it is developed with a developing solution containing one or more of the development restrainers described above.

The developing solution prepared according to formulation described above has a pH of 9–12, with the range of 10–11 being particularly preferred from the viewpoint of preservability and photographic characteristics.

The term "dry-to-dry time" as used herein means the total time required for the "tip" of a film entering an automatic processor to pass through a developing tank, a crossover zone, a fixing tank, a crossover zone, a washing tank, a crossover zone, a drying zone and emerge from the drying zone. In other words, the "dry-to-dry time" may be calculated by dividing the total processing line (in meters) by the line transport speed (m/sec). In accordance with the present invention, the processing of the photographic material is to be completed within a dry-to-dry time of 50 seconds. The reason for including the crossover times in the dry-to-dry time is well known in the art; photographic processing can be considered to proceed effectively even in the crossover zones since the photographic material in each crossover section is swollen by the solution carried over from the previous step.

The following examples are provided for the purpose of further illustrating the present invention but are in no way to be taken as limiting.

EXAMPLE 1

A mixture of gelatin, sodium chloride and water was put into a vessel and heated at 40° C. Thereafter, an aqueous solution of silver nitrate and an aqueous solution of a mixture of potassium bromide and sodium chloride that had potassium hexachloroiridate and potassium hexabromorhodate added in respective amounts of $2\times10^{-6}$ moles and $4\times10^{-7}$ moles per mole of silver halide were added by a double-jet method to prepare silver chlorobromide grains (35 mol% AgBr; spread of distribution, 12%; cubic crystals; grain size, 0.33 μm) with pH and pAg being held at 3.0 and 7.7, respectively. After reversion of pH to 5.9, the grains were desalted in the usual manner.

The emulsion thus prepared was gold-plus-sulfur sensitized, followed by addition of spectral sensitizers (a) and (b) each in an amount of 20 mg per mole of silver halide. Further, 1-phenyl-5-mercaptotetrazole and 4-hydroxy-6-methyl-1,3,3a,7-tetrazaindene were added in respective amounts of 13 mg and 9.0 g per mole of silver halide. The ripening of the emulsion was quenched by adding gelatins having the jelly strengths shown in Table 1. Further, hydroquinone, potassium bromide, saponin, a styrene-maleic acid polymer and a polymer latex of ethyl acrylate were added in respective amounts of 4 g, 3 g, 5 g, 2 g and 3 g per mole of silver halide. Subsequently, a sodium salt of 1-hydroxy-3,5-dichlorotriazine and formaldehyde were added as hardeners to prepare an emulsion coating solution. In the next place, a coating solution of protective layer was prepared by adding the following components to an aqueous solution of gelatin (500 g): 10 g of potassium bromide; 4 g of sodium 1-decyl-2-(3-isopentyl)succinato-2-sulfonate; 20 mg/m² of fine particulate polymethyl methacrylate (matting agent); 200 mg/m² of fine particulate silica (matting agent); and formaldehyde and sodium salt of 1-hydroxy-3,5-dichloro-s-triazine (hardeners). The emulsion coating solution and the coating solution of protective layer were applied simultaneously in superposition on one side of a subbed polyethylene terephthalate base film 100 μm thick to form an emulsion and a protective layer. The silver deposit in the emulsion layer was 3.5 g/m². For the gelatin deposits in the emulsion and protective layers, see Table 1.

The other side of the base film was coated with a backing layer and a protective layer. The backing layer was applied from a gelatin solution containing a dye (c) in such a way that the gelatin and dye (c) deposits would be 2.0 g/m² and 100 mg/m², respectively. The protective layer was applied from a gelatin solution containing fine particulate (average particle size, 5 μm) polymethyl methacrylate (PMMA) in such a way that the gelatin and PMMA deposits would be 1.0 g/m² and 50 mg/m², respectively. Spectral sensitizer (a):

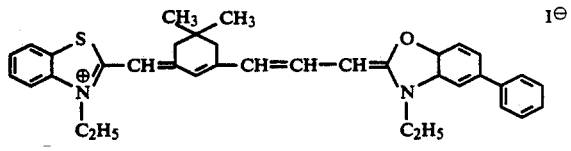

Spectral sensitizer (b):

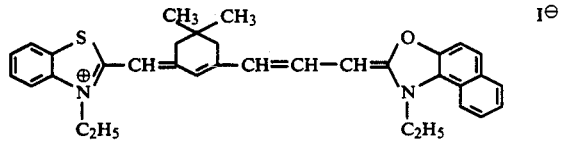

Spectral sensitizer (c):

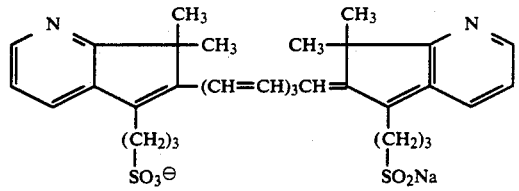

The samples thus prepared were processed with a conventional roller-transport processor under the conditions shown below using the developing and fixing solutins also shown below. The processed samples were evaluated for "rainbow gloss", dot quality, as well as unevenness in development and fixing.

The results of evaluation were rated by the following criteria: 1–4, unacceptable; 5–10, acceptable, with 10 being the best. The results are shown in Table 1.

TABLE 1

| Sample No. | 1 | 2 | 3 | 4 | 5 | 6 | 7 | 8 |
|---|---|---|---|---|---|---|---|---|
| Emulsion layer | | | | | | | | |
| gelatin deposit (g/m²) | 2.0 | 2.0 | 2.0 | 2.0 | 2.0 | 1.8 | 1.8 | 1.8 |
| jelly strength (J.S.) | 150 | 250 | 150 | 250/150 | 250 | 150 | 250/150 | 250 |
| Protective layer | | | | | | | | |
| gelatin deposit (g/m²) | 1.0 | 1.0 | 0.7 | 0.7 | 0.7 | 0.6 | 0.6 | 0.6 |
| jelly strength (J.S.) | 150 | 150 | 150 | 150 | 150 | 150 | 250 | 250 |
| Proportion (%) of gelatin with J.S. of 200 or more* | 0 | 67 | 0 | 50 | 70 | 0 | 70 | 100 |
| Rainbow gloss | 8 | 9 | 3 | 6 | 7 | 2 | 8 | 9 |
| Unevenness in development | 8 | 9 | 6 | 7 | 7 | 6 | 8 | 8 |
| Unenveness in | 2 | 2 | 7 | 7 | 7 | 9 | 10 | 10 |

TABLE 1-continued

| Sample No. | 1 | 2 | 3 | 4 | 5 | 6 | 7 | 8 |
|---|---|---|---|---|---|---|---|---|
| fixing | | | | | | | | |
| Dot quality | 8 | 8 | 9 | 9 | 9 | 9 | 9 | 9 |
| Remarks | Comparison | do. | do. | Invention | do. | Comparison | Invention | do. |

*Proportion relative to the total gelatin content of emulsion and protective layers Table 1 shows that the samples prepared in accordance with the present invention experienced less rainbow gloss, had good dot quality and suffered from less uneveness in development and fixing.

In all the test runs, the line speed was 1,800 mm/min.

Processing conditions:

| Step | Temperature (°C.) | Time (sec) |
|---|---|---|
| Development | 35 | 12 |
| Fixing | 34 | 12 |
| Washing | R.T. | 12 |
| Drying | 50 | 10 |

Recipe of developing solution:

| | |
|---|---|
| Solution A | |
| Pure water (ion-exchanged water) | 150 ml |
| Ethylenediaminetetraacetic acid disodium salt | 2 g |
| Diethylene glycol | 50 g |
| Potassium sulfite (55% w/v aq. sol.) | 100 ml |
| Potassium carbonate | 50 g |
| Hydroquinone | 15 g |
| 5-Methyl benzotriazole | 200 mg |
| 1-Phenyl-5-mercaptotetrazole | 30 mg |
| Potassium hydroxide | q.s. to adjust pH to 10.4 after use |
| Potassium bromide | 4.5 g |
| Solution B | |
| Pure water (ion-exchanged water) | 3 ml |
| Diethylene glycol | 50 g |
| Ethylenediaminetetraacetic acid disodium salt | 25 mg |
| Acetic acid (90% aq. sol.) | 0.3 ml |
| 5-Nitroindazole | 110 mg |
| 1-Phenyl-3-pyrazolidone | 700 mg |

Just prior to use, solutions A and B were dissolved, in the order written, into 500 ml of water and worked up to 1,000 ml.

Recipe of fixing solution:

| | |
|---|---|
| Solution A | |
| Ammonium thiosulfate (72.5% w/v aq. sol.) | 240 ml |
| Sodium sulfite | 17 g |
| Sodium acetate ($3H_2O$) | 6.5 g |
| Boric acid | 6 g |
| Sodium citrate ($2H_2O$) | 2 g |
| Acetic acid (90% w/v aq. sol.) | 13.6 ml |
| Solution B | |
| Pure water (ion-exchanged water) | 17 ml |
| Sulfuric acid (50% w/v aq. sol.) | 4.7 g |
| Aluminum sulfate (8.1% w/v aq. sol. in terms of $Al_2O_3$) | 26.5 g |

Just prior to use, solutions A and B were dissolved, in the order written, into 500 ml of water and worked up to 1,000 ml. The conditioned fixing solution had a pH of ca. 4.3.

EXAMPLE 2

Samples were prepared as in Example 1 except that spectral sensitizers (a) and (b) and dye (c) were replaced by spectral sensitizers (d), (e) and (f) and that emulsion and protective layers having the features described in Table 2 were formed. The samples were evaluated as in Example 1 and the results are also shown in Table 2.

(d)

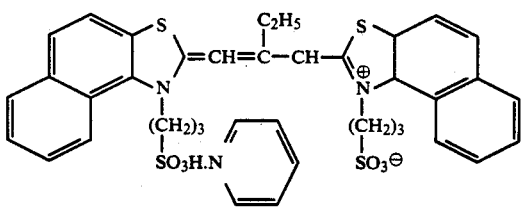

(e)

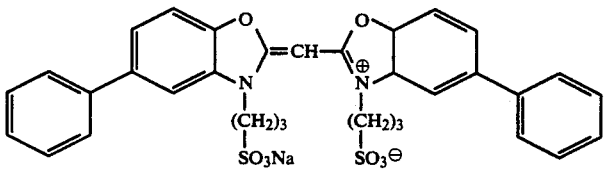

(f)

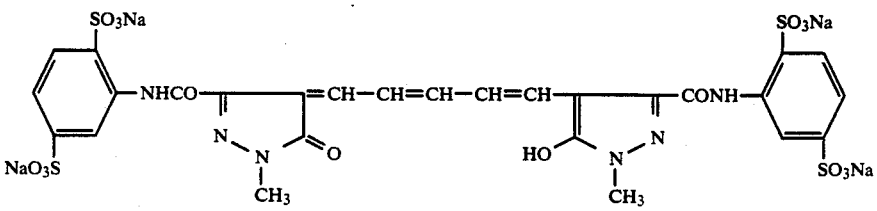

TABLE 2

| Sample No. | 1 | 2 | 3 | 4 | 5 | 6 | 7 | 8 |
|---|---|---|---|---|---|---|---|---|
| Emulsion layer | 2.2 | 2.2 | 2.1 | 2.1 | 2.1 | 1.5 | 1.5 | 1.5 |
| gelatin deposit ($g/m^2$) | | | | | | | | |
| jelly strength (J.S.) | 150 | 250 | 150 | 250/150 | 250 | 150 | 250/150 | 250 |
| Protective layer | | | | | | | | |
| gelatin deposit ($g/m^2$) | 100 | 0.7 | 0.7 | 0.7 | 0.7 | 0.5 | 0.5 | 0.5 |
| jelly strength (J.S.) | 150 | 150 | 150 | 150 | 150 | 150 | 250 | 250 |
| Proportion (%) of gelatin with J.S. of 200 or more | 0 | 76 | 0 | 50 | 75 | 0 | 75 | 100 |
| Rainbow gloss | 9 | 9 | 3 | 7 | 8 | 2 | 9 | 10 |
| Uneveness in development | 7 | 7 | 7 | 7 | 7 | 10 | 10 | 10 |
| Uneveness in fixing | 2 | 2 | 6 | 6 | 6 | 10 | 10 | 10 |
| Dot quality | 9 | 9 | 9 | 9 | 10 | 10 | 10 | 10 |
| Remarks | Comparison | do. | do. | Invention | do. | Comparison | Invention | do. |

Table 2 shows that the samples prepared in accordance with the present invention experienced less rainbow gloss, had good dot quality and suffered from less uneveness in development and fixing.

It is therefore clear that according to the present invention, silver halide photographic materials can be processed for rapid access to produce images of high dot quality having less rainbow gloss while causing reduced unevenness in coating thickness as well as in development and fixing.

What is claimed is:

1. A silver halide photographic material comprising a support and a photographic layer unit thereon, wherein said photographic layer unit comprises a light sensitive layer having silver halide grains, of which a chloride content is not less than 30 mol %, and said photographic layer unit comprises not more than 2.8 $g/m^2$ of gelatin, and a portion not less than 50 wt % of said gelatin has a jelly strength of not less than 240.

2. A material according to claim 1 wherein said photographic material has an anti-halo layer on the side of the support opposite the side carrying the light-sensitive layer.

3. A material according to claim 2 wherein the gelatin in said anti-halo layer has a jelly strength of at least 240.

4. A material according to claim 2 wherein the content of gelatin in said anti-halo layer is 2.8–4.5 $g/m^2$.

5. A material according to claim 1 wherein the silver halide grains incorporated in the emulsion layer have an average grain size of 0.1–1.0 μm.

6. A material according to claim 1 wherein the silver halide grains incorporated in the emulsion layer have a coefficient of variation of no more than 15% as defined by (standared deviation of grain size/average grain size)×100.

7. A material of claim 1, wherein a gamma value of a characteristic curve of said silver halide photographic material is not less than 6.0 between density points of 0.3 and 3.0 of said characteristic curve.

8. A method for forming an image on a silver halide photographic material having a support and a photographic layer unit thereon comprising exposing said silver halide photographic material, and processing said silver halide photographic material within 50 seconds on a basis of a dry to dry state of said silver halide photographic material, wherein said photographic layer unit comprises not more than 2.8 $g/m^2$ of gelatin, and a portion not less than 50 wt % of said gelatin has a jelly strength of not less than 240, and said photographic layer unit comprises a light-sensitive layer having silver halide grains, a chloride content of said silver halide grains being not less than 30 mol %.

9. A method of claim 8, wherein said dry to dry state is from a first state of said silver halide photographic material at inserting a tip of said silver halide photographic material into an automatic processor to a second state of said silver halide photographic material at emerging from said automatic processor.

* * * * *